United States Patent [19]

Hoffman et al.

[11] 4,043,850

[45] Aug. 23, 1977

[54] POLYMERIC-COATED HMX CRYSTALS FOR USE WITH PROPELLANT MATERIALS

[75] Inventors: Richard E. Hoffman, Sandy, Utah; Edward K. Lindsay, Cumberland, Md.

[73] Assignee: The United States of America as represented by the Secretary of the Navy, Washington, D.C.

[21] Appl. No.: 712,417

[22] Filed: Aug. 6, 1976

[51] Int. Cl.[2] ..... C06B 45/10

[52] U.S. Cl. ..... 149/19.4; 149/92

[58] Field of Search ..... 149/11, 19.4, 92

[56] References Cited

U.S. PATENT DOCUMENTS

| | | | |
|---|---|---|---|
| 3,260,631 | 7/1966 | Witz et al. | 149/19.4 X |
| 3,834,957 | 9/1974 | McDevitt et al. | 149/92 X |
| 3,894,894 | 7/1975 | Elrick | 149/92 X |
| 3,951,704 | 4/1976 | Stack | 149/92 X |

*Primary Examiner*—Peter A. Nelson

*Attorney, Agent, or Firm*—Richard S. Sciascia; Paul N. Critchlow

[57] ABSTRACT

The adhesion of HMX crystals to the binder of a propellant material is significantly improved by providing a polymeric polyurethane coating. The HMX crystals are tumbled in benzene to which is added a dilute solution of poly-aryl phenylisocyanate in methylene chloride, water and triethylamine. A secondary coating then may be applied by reacting residual isocyanates with ethanol.

4 Claims, No Drawings

POLYMERIC-COATED HMX CRYSTALS FOR USE WITH PROPELLANT MATERIALS

BACKGROUND OF THE INVENTION

The invention relates to slurry-cast double base propellants and, in particular, to crystalline oxidizer-fuels used with such propellants.

Cyclotetramethylenetetranitramine (HMX) is a crystalline oxidizer-fuel commmonly incorporated into slurry-cast double base propellants which, as is known, employ binder materials to promote mechanical adhesion. However, the propellant binder does not adhere to the smooth facets of the HMX crystals. Consequently, when the cured propellant is subjected to external loads of certain magnitudes, a phenomenon known as crystal 'dewetting' occurs. In other words, the binder pulls away from the crystals and the crystals are ejected from the propellant surface. The mechanical properties of the propellant are significantly limited by this occurence since the reinforcing effect of the filler on the binder strength is not realized.

The present invention provides a polymeric coating for the crystals which avoids the 'dewetting'and improves the mechanical properties of the propellant.

DETAILED DESCRIPTION OF THE INVENTION

The coating is applied by tumbling the HMX in benzene to which is added a very dilute solution of polyaryl phenylisocyanate in methylene chloride, water and triethylamine to catalyse the reaction and form a polyurethane primary coating on the crystals. The methylene chloride is extracted by the benzene and, after several washes with dry benzene, a secondary coating is applied by mixing the washed crystals in an ethanol solution to react with any residual isocyanates of the initial or primary reaction.

The coated HMX then is filtered, dried and incorporated in the propellant. HMX coated in this manner has been incorporated in an aluminized cross-linked double-base propellant formulation that is slurry-cast with 30 wt. % binder (nitrocellulose) and 51 wt % coated HMX. The coated HMX was incorporated in one-pound samples of the double-base propellant and the samples tested at 77° F and at a strain rate of 0.74 $min^{-1}$ with Instron tensile test equipment. The isocyanate-to-hydroxyl ratio for this propellant formulation was 1:2. When tested against identical formulations using uncoated HMX crystals, the mechanical properties of the compared samples were as follows:

| | Control | Coated-HMX | % |
|---|---|---|---|
| Tensile strength, psi | 38 | 47 | + 24 |
| Elongation, % | 7 | 26 | +370 |
| Modulus, psi | 680 | 810 | + 19 |

The improvement in the propellant mechanical properties is attributed to the polymeric coating formed on the HMX crystals.

The improvements demonstrated by the particular samples clearly are applicable to various double-base, slurry-cast propellants and, probably, to a wide variety of propellants. Also, the advantages apply for the various well-known binders, such as nitrocellulose or glycerin, conventionally used in these propellant formulations. In general, it appears that the coating provides a tough, irregular surface skin to which the propellants can adhere mechanically. Chemical bonding also occurs during propellant cure from the diffusivity of solvent through the coating. A significant finding is that the cohesive strength of the polymeric coating is greater than that of the binder. consequently, the ultimate stress failure site is shifted from that of the HMX/binder to that of the binder cohesivity itself. The use of the polymeric coating for other crystalline oxidizer-fuels has not as yet been investigated although it would appear that similar advantages might be realized.

The primary and secondary coatings have been formulated as follows:

1. Primary Coat
   a. Vacuum-dry HMX at 50-60° C about 18 hours.
   b. Prepare solutions:
      PAPI-18 (poly-aryl isocyanate): 100 mg/ml methylene chloride
      Benzene, dry: distilled
      Triethylamine: 50 mg/ml Benzene, dry
      Benzene, wet: 0.45 mg distilled $H_2O$/ml Benzene, dry Procedure:
   PAPI-18 (2 wt. % of HMX) crosslinked with water to an isocyanate-to-hydroxyl ratio (NCO/OH) of 3:1; HMX slurry = 2 ml liquid/gram HMX.
   To 10 g HMX add 7.8 ml dry benzene, 9.8 ml wet benzene, 2 ml PAPI-18 solution and 0.5 ml triethylamine.
   slurry mix 1 hour at 70°-80° F Wash three times with 20 ml dry benzene
2. Secondary Coating
   a. Prepare solutions:
      Ethyl alcohol (absolute): 50 mg/ml Benzene, dry
      Dibutyltin diacetate (DBTDA): 50 mg/ml Benzene, dry
      Benzene, dry : Distilled Procedure:
   The ethanol reacts with the residual isocyanate groups to a final stoichiometry of NCO/OH = 1.
   To the primary coated HMX add 14 ml dry benzene, 2 ml DBTDA solution and 4 ml alcohol solution.
   Slurry mix 2 hours at 70°-80° F; wash three times with 20 ml absolute alcohol and two times with dry benzene. Filter and dry HMX; incorporate in propellant.

These detailed formulation procedures, of course, can be varied providing the essential reactions are achieved.

As indicated, the coated HMX crystals are of significant benefit in substantially improving the mechanical properties of the propellants in which they are used and the benefits are attributable to the polymeric coating.

Obviously many modifications and variations of the present invention are possible in the light of the above teachings. It is therefore to be understood that within the scope of the appended claims the invention may be practiced otherwise than as specifically described.

We claim:

1. A propellant composition comprising:
a binder material,
a propellant material, and
a crystalline oxidizer fuel,
said binder and material and said fuel being incorporated in said propellant material and said oxidizer fuel consisting of:
cyclotetramethylenetetranitramine (HMX) crystals having a dry film polyurethane primary coating formed on the crystals by catalytically reacting a solution of a poly-aryl isocyanate with water to an isocyanate-to-hydroxyl ratio of about 3:1.

2. The oxidizer-fuel of claim 1 further including a secondary coating formed by reacting residual isocyanates present in said primary coating with ethanol to a final stoichiometry of about 1.0.

3. The oxidizer-fuel of claim 2 wherein:

said primary coating is reactively formed on said crystals by tumbling said HMX crystals in a dilute solution of poly-aryl isocyanate and methylene chloride and by mixing the HMX slurry with dry benzene, triethylamine and a wet benzene, and said secondary coating is formed by mixing said primary-coated crystals in an ethanol solution.

4. The composition of claim 1 wherein said propellant material is a slurry-cast double-bond material.

* * * * *